US005555651A

United States Patent [19]

Sartor et al.

[11] Patent Number: 5,555,651

[45] Date of Patent: Sep. 17, 1996

[54] FOOT SECURING DEVICE PARTICULARLY FOR SKI BOOTS

[75] Inventors: Claudio Sartor, Zero Branco; Roberto Gorza, Feltre, both of Italy

[73] Assignee: Nordica S.p.A., Trevignano, Italy

[21] Appl. No.: 494,213

[22] Filed: Jun. 23, 1995

[30] Foreign Application Priority Data

Jul. 7, 1994 [IT] Italy ..... TV94A0079

[51] Int. Cl.[6] ..... A43B 5/04; A43B 5/16

[52] U.S. Cl. ..... 36/117.7; 36/50.5

[58] Field of Search ..... 36/50.5, 117, 118, 36/119, 120, 121

[56] References Cited

U.S. PATENT DOCUMENTS

| | | | |
|---|---|---|---|
| 4,192,087 | 3/1980 | Salomon | 36/119 |
| 4,620,377 | 11/1986 | Pozzebon | 36/119 |
| 4,802,290 | 2/1989 | Marega | 36/119 |
| 4,942,681 | 7/1990 | Benoit et al. | 36/119 |
| 4,949,480 | 8/1990 | Hercog et al. | 36/119 |
| 5,001,851 | 3/1991 | Baggio et al. | 36/119 |
| 5,129,166 | 7/1992 | Montfort et al. | 36/119 X |
| 5,347,231 | 9/1994 | Iwama | 36/119 |

FOREIGN PATENT DOCUMENTS

| | | |
|---|---|---|
| 0073991 | 3/1983 | European Pat. Off. . |
| 0157118 | 10/1985 | European Pat. Off. . |
| 0165495 | 12/1985 | European Pat. Off. . |
| 0316605 | 5/1989 | European Pat. Off. . |
| 0336921 | 10/1989 | European Pat. Off. . |
| 2640477 | 6/1990 | France . |

*Primary Examiner*—B. Dayoan

*Attorney, Agent, or Firm*—Guido Modiano; Albert Josif

[57] ABSTRACT

The foot securing device has a bar defining a first portion and a second portion, which are complementarily threaded, and which rotatably engage a first block and a second block that are movable on the bar. The ends of the first and second blocks are articulated by a first elastic element and a second elastic element. Each of the elastic elements has an intermediate portion extending around a pivot connected to a plate, below which a presser may be associated.

7 Claims, 2 Drawing Sheets

FOOT SECURING DEVICE PARTICULARLY FOR SKI BOOTS

BACKGROUND OF THE INVENTION

The present invention relates to a foot securing device, particularly for ski boots.

A problem in ski boots is that of correctly securing the foot inside the boot to allow optimum transmission of forces from the foot to the ski, while skiing.

Ski boots that apply a foot securing device inside the shell, are accordingly known, such as the device disclosed in French patent published as no. 2,381,483.

This patent discloses a device that comprises a presser constituted by two jaws that laterally surround the foot and can be moved mutually closer by means of an adapted screw that interacts with them; the stem of said screw has right- and left-hand threads.

The screw can also have an eccentric-shaped head.

The drawback observed in this conventional device is constituted by the fact that in addition to being constructively complicated, is that the fine adjustment, obtained by turning the screw, depends from the quick securing, also obtained by turning the screw in order to displace the eccentric element. However, the eccentric element cannot be displaced more than a short distance because of limited lateral size.

Accordingly, once the degree of securing has been adjusted, the closure of the screw tightens the device further, forcing the skier to perform successive adjustments before achieving the desired degree of closure.

Furthermore, the securing action on the side of foot produces a discomfort or fatigue, because the lateral bones of the foot are compressed.

These lateral compressions can also cause the sole of the foot to rise by arching, and this does not allow optimum transmission of forces from the foot to the ski.

The fact is also observed that the user may inadvertently disengage the stem of the screw and the complementarily threaded seats formed on the jaws, consequently making the device unusable.

As a partial solution to some of the above-mentioned drawbacks, EP 0073991 discloses an adjustment device that comprises a bar rotatably supported by a boot. The bar can be actuated from outside, and has a first portion and a second portion with right- and left-hand threads. A first block and a second block that are movable along the bar rotatably engage with said first and second portions. One end of a first linkage and a second linkage are articulated to the blocks and, at the other end, the linkages are articulated to an adjustment device that is constituted by a plate with which a presser is downwardly associated.

Although this device allows good adjustment of the degree of pressure applied at said presser, which is usually arranged inside the shell, it still has the drawback that it allows possible mutual disengagement of the threaded bar and of the first and second blocks, consequently making the device unusable.

Moreover, every time the user puts the boot on, he must first of all engage the knob, performing a rotation that mutually spaces the first and second blocks, thus allowing to lift the presser in order to leave room for inserting the foot.

Then, once the foot has been inserted, the user must again turn the knob in the opposite direction to move the first block and the second block mutually closer, so as to achieve the desired securing of the foot.

These operations are long and not always easy.

SUMMARY OF THE INVENTION

The aim of the present invention is to solve the described technical problems, eliminating the drawbacks of the mentioned prior art by providing a device that allows the user to quickly and easily achieve optimum securing of the foot inside the boot.

Within the scope of the above aim, an important object is to provide a device that allows to secure the foot without requiring the user to preset said device depending on whether he must insert or remove the foot.

Another important object is to provide a securing device in which the interaction between the threaded bar and the first and second blocks, that are movable thereon, is constantly maintained.

Another object is to provide a device that associates with the preceding characteristics that of being reliable and safe in use and has low manufacturing costs.

This aim, these objects, and others which will become apparent hereinafter are achieved by a foot securing device, particularly for ski boots, comprising a bar having complementary threaded first and second portions, said portions rotatably engage a first block and a second block that are movable on said bar, characterized in that said first and second blocks are engaged by at least one flexible element.

BRIEF DESCRIPTION OF THE DRAWINGS

Further characteristics and advantages of the invention will become apparent from the detailed description of a particular but not exclusive embodiment, illustrated only by way of non-limitative example in the accompanying drawings, wherein.

DESCRIPTION OF THE PREFERRED EMBODIMENTS

Figure 1:
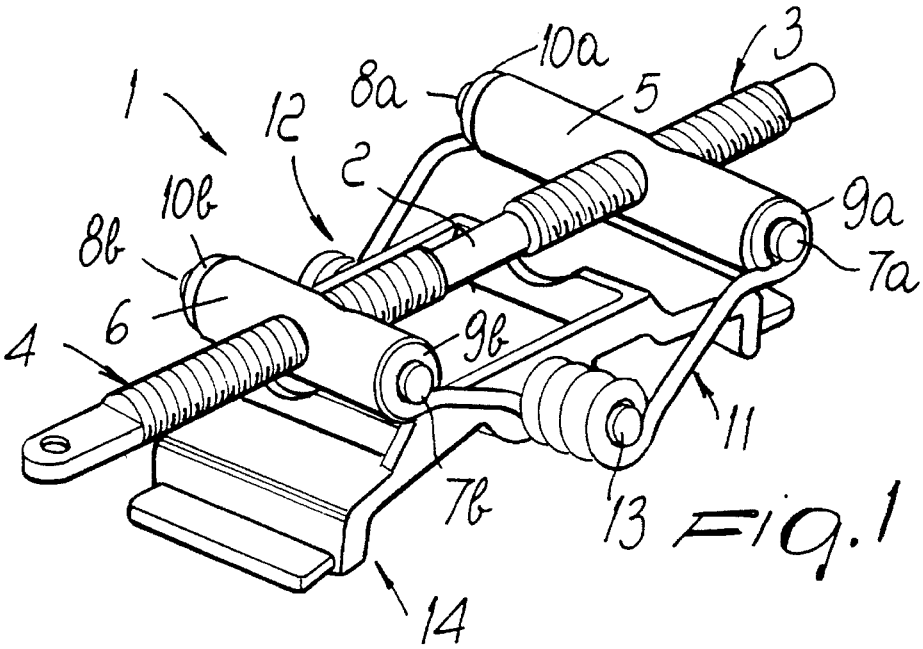
FIG. 1 is a lateral perspective view of the securing device.

With reference to the figures, the reference numeral 1 generally designates the securing device, comprising a bar having a first portion 3 and a second portion 4 that are complementarily threaded.

A first block 5 and a second block 6 are rotatably associated at the first portion and at the second portion respectively, and are threaded to engage said first and second portions.

Said first and second blocks advantageously have a cylindrical shape, the first block 5 being longitudinally longer than the second block 6.

The third ends 9*a*, 9*b* and the fourth ends 10*a*, 10*b* of a first elastic element 11 and of a second elastic element 12 are articulated at the first ends 7*a*, 7*b* and at the second ends 8*a*, 8*b* of the first and second blocks respectively.

Each one of said first and second elastic elements is advantageously constituted by a spring which, in a region that is intermediate between the third and fourth ends, is partially wound at a pivot 13 that is transversely associated with a plate 14 below which a presser, not shown in the figures, is associated.

Said springs that constitute the first and second elastic elements are in a neutral position when the first block 5 and the second block 6 are arranged approximately halfway along the respective first portion 3 and second portion 4 of the bar 2.

One end of the bar is connected to an activation knob 20 arranged outside the shell 21. A rotation of the knob, and therefore of the bar, causes the first and second blocks to move away or towards each other, thereby causing the compression or elongation of the first and second flexible elements 11 and 12.

Should the user move the first and second blocks too close to each other or too far apart, so as to no longer make them interact with the complementarily threaded surfaces of the first and second portions of the bar 2, the pressure applied to the first block 5 and to the second block 6, by the first and second flexible elements, will force the blocks to move adjacent to the first thread of the respective first and second portions of the bar, so that an opposite rotation applied by the user will again allow automatic interaction between them.

Therefore, both when the user moves the first and second blocks too close to each other and when he moves them too far apart, therefore in the direction for disengaging them from the respective threads of the first and second portions of the bar 2, an opposite rotation performed by the user in any case entails automatic re-engagement and therefore allows to optimally restore the operation of the device.

It has thus been observed that the invention has achieved the intended aim and objects, a securing device having been provided that maintains its functionality even in case of incorrect operations by the user that may cause the first block 5 and the second block 6 to disengage from the threads of the first portion 3 and of the second portion 4 of the bar 2, allowing automatic re-engagement thereof.

The device also allows the user to insert the foot in the shell and remove it from said shell even without acting on the bar 2, since the plate 14 is allowed to move vertically by means of an optional deformation of the first and second deformable elements.

The device according to the invention is susceptible of numerous modifications and variations within the scope of the same inventive concept.

Figure 6:
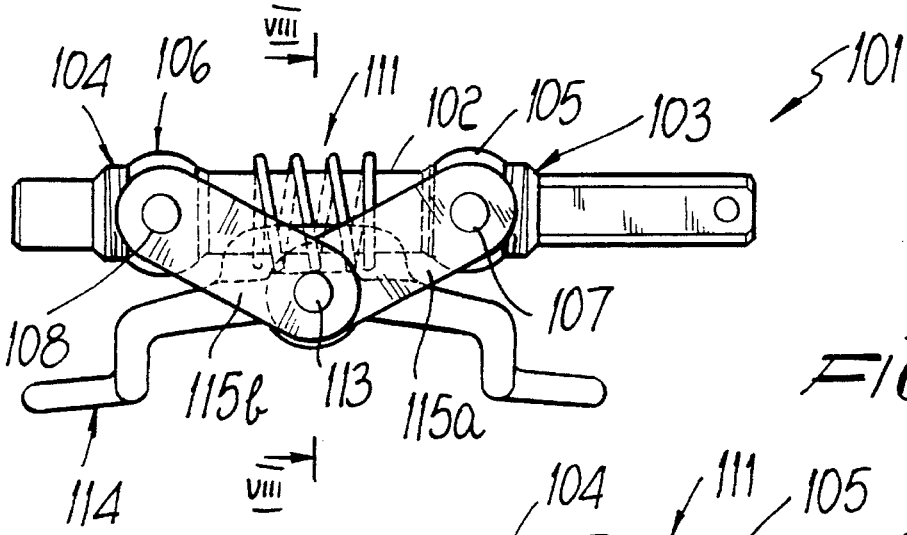
FIG. 6 is a view, similar to FIG. 2, of a further embodiment of the device according to the invention.
Figure 7:
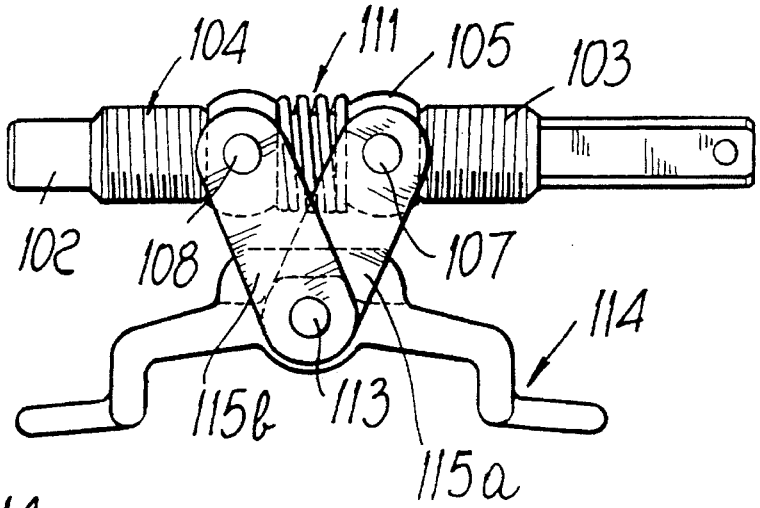
FIG. 7 is a view, similar to FIG. 4, of the embodiment of FIG. 6.
Figure 8:
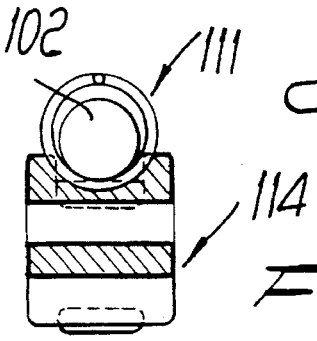
FIG. 8 is a sectional view, taken along the plane VIII—VIII of FIG. 6.
Figure 2:
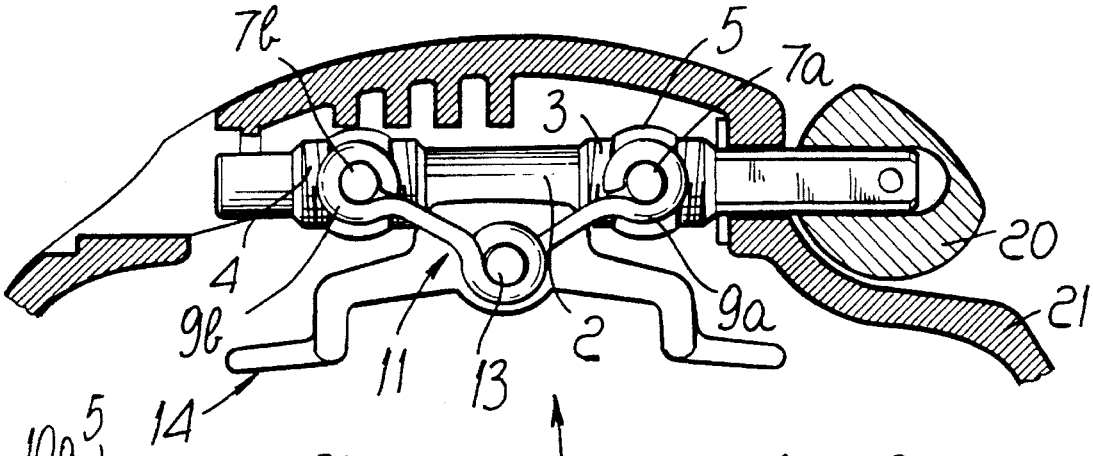
FIG. 2 is a sectional view of the securing device.
Figure 3:
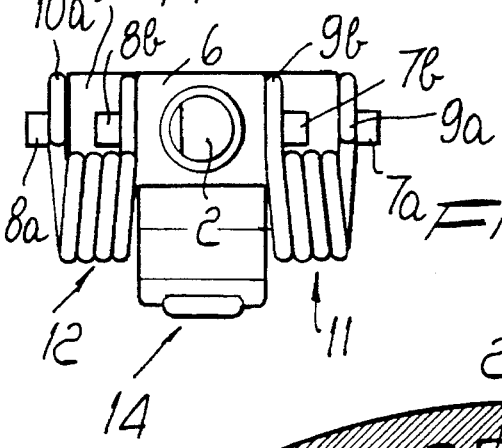
FIG. 3 is a side view of FIG. 2.
Figure 4:
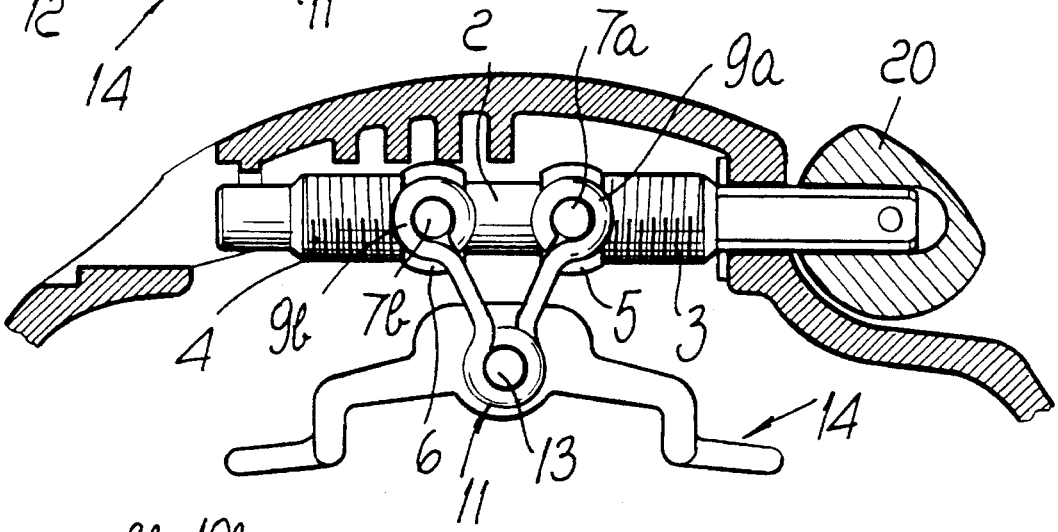
FIG. 4 is a view, similar to FIG. 2, of the condition of the device when the first and second blocks are close.
Figure 5:
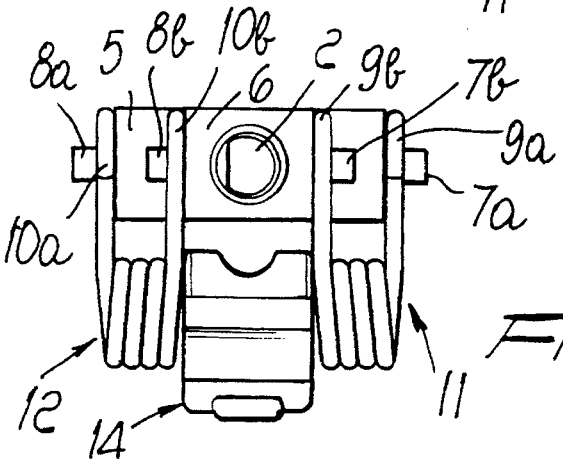
FIG. 5 is a view, similar to FIG. 3, of the condition of FIG. 4.

For example, FIGS. 6, 7, and 8 illustrate a further embodiment of a securing device 101, which comprises a bar 102 having complementarily threaded first portion 103 and second portion 104. A first block 105 and a second block 106 are respectively threadedly engaged with portions 102 and 103.

The first ends 107 of the first block 105 and the second ends 108 of the second block 106 are connected by means of two pairs of linkages, designated by the reference numerals 115*a* and 115*b*, which are connected at the pivot 113 that is arranged transversely with respect to the plate 114 and the bar 102.

A elastic element 111 is arranged coaxially to the bar 102 in the interspace between the first portion 103 and the second portion 104, and is constituted by a cylindrical helical spring that is arranged coaxially to said bar 102.

The length of said spring is such as to allow, in case of an excessive rotation applied to the bar 102 that causes the first block 105 and the second block 106 to disengage from the threads of the first portion 103 and of the second portion 104, to nonetheless push said first and second blocks adjacent to the threads of the first and second portions.

This allows, as in the previous case and thus when the user applies an opposite rotation to the bar, to re-engage the first and second blocks with the first and second portions of the bar 102 and thus to reactivate the securing device.

The materials and the dimensions that constitute the individual components of the device may of course also be the most pertinent according to the specific requirements.

What is claimed is:

1. Foot securing device, particularly for ski boots, comprising a bar having complementarily threaded first and second portions, said portions rotatably engage a first block and a second block that are movable on said bar, wherein said first and second blocks are engaged by at least one elastic element, wherein said first and second blocks are connected, at the respective first and second ends, by means of the articulation of third and fourth ends of first and second elastic elements.

2. Device according to claim 1, wherein each one of said first and second elastic elements is constituted by a spring which is wound, in an intermediate region between said third and fourth ends, at a pivot that is transversely associated with a plate.

3. Device according to claim 2, wherein said first and second elastic elements are in a neutral position when said first and second blocks are arranged approximately halfway along first and second portions of said bar.

4. Foot securing device particularly for ski boots comprising a bar, a first threaded portion defined on said bar, a second threaded portion defined on said bar, an interspace defined on said bar between said first threaded portion and said second threaded portion, a first block threadedly engaging said first threaded portion, a second block threadedly engaging said second threaded portion, a plate having connected thereto a pivot, linkages connecting said pivot to said first block and to said second block, and at least one elastic element arranged coaxially with respect to said bar at said interspace, said first block and said second block being mutually movable towards and away from said elastic element upon rotating said bar, said first block and said second block engaging said elastic element upon being located at said interspace, said elastic element maintaining said first block and said second block in screw thread engagement with said first threaded portion and said second threaded portion when said first block and said second block are located at said interspace.

5. Foot securing device according to claim 4, wherein said pivot comprises a single pivot arranged transversely with respect to said plate and said bar, and wherein said linkages comprise at least one pair of linkages interconnecting said first block and said second block to said single pivot.

6. Foot securing device according to claim 4, wherein said elastic element comprises at least one helical compression spring engageable with said first block and said second block upon moving said first block and said second block to said interspace by rotating said bar.

7. Foot securing device particularly for ski boots comprising a bar, a first threaded portion defined on said bar, a second threaded portion defined on said bar, an interspace defined on said bar between said first threaded portion and said second threaded portion, a first block threadedly engaging said first threaded portion, a second block threadedly engaging said second threaded portion, a plate having connected thereto a single pivot, said single pivot being arranged transversely with respect to said plate and said bar, at least one pair of linkages connecting said single pivot to said first block and to said second block, and at least one helical compression spring arranged coaxially with respect to said bar at said interspace, said first block and said second block being mutually movable towards and away from said helical compression spring upon rotating said bar, said first block and said second block engaging said helical compression spring upon being located at said interspace, said helical compression spring maintaining said first block and said second block in screw thread engagement with said first threaded portion and said second threaded portion when said first block and said second block are located at said interspace.

* * * * *